US005560723A

United States Patent [19]

Kobayashi

[11] Patent Number: 5,560,723

[45] Date of Patent: Oct. 1, 1996

[54] SHUTTLE DRIVING MECHANISM OF PRINTER APPARATUS

[75] Inventor: Atsuhisa Kobayashi, Hyogo, Japan

[73] Assignee: Fujitsu Limited, Kawasaki, Japan

[21] Appl. No.: 245,039

[22] Filed: May 17, 1994

[30] Foreign Application Priority Data

Sep. 20, 1993 [JP] Japan ..... 5-233823

[51] Int. Cl.[6] ..... B41J 19/14

[52] U.S. Cl. ..... 400/323; 101/93.04; 400/322

[58] Field of Search ..... 400/322, 323, 400/328, 341, 352, 354; 347/37, 38, 39

[56] References Cited

FOREIGN PATENT DOCUMENTS

| | | | |
|---|---|---|---|
| 0580330A2 | 1/1994 | European Pat. Off. . | |
| 3041170A1 | 5/1981 | Germany . | |
| 3213626A1 | 4/1983 | Germany . | |
| 61-169257 | 7/1986 | Japan | 400/323 |
| 6-040108 | 2/1994 | Japan | 400/323 |

OTHER PUBLICATIONS

Patent Abstracts of Japan, M-546 with a copy of JP 61-169257.

Patent Abstracts of Japan, M-494 with a copy of JP 61-32764.

*Primary Examiner*—David A. Wiecking

*Attorney, Agent, or Firm*—Nikaido, Marmelstein, Murray & Oram LLP

[57] ABSTRACT

A shuttle mechanism of a printer apparatus wherein a balance shuttle unit is arranged on the opposite side of the print head in a print shuttle unit, for instance, on the under side of said print shuttle unit, so that the center of the gravity of the print shuttle unit is made to become close to that of the balance shuttle unit. Common components such as the magnet, yoke, guide member may be employed in both the shuttle units.

4 Claims, 11 Drawing Sheets

SHUTTLE DRIVING MECHANISM OF PRINTER APPARATUS

BACKGROUND OF THE INVENTION

1. Field of the Invention

The present invention relates to a shuttle mechanism of a printer apparatus where a print head reciprocates so as to carry out printing.

2. Description of Related Art

FIG. 1 is a schematic appearance of a dot line printer apparatus. In FIG. 1, numeral 7 designates a paper feed unit, numeral 8 designates a print mechanism section containing a print shuttle unit with a print head mounted thereon, and numeral 9 designates a ribbon unit equipped with an ink ribbon. While the print head is making linear reciprocating motions, it strikes the ink ribbon of the ribbon unit 9 and carries out printing to a paper 4 sent to the inside of the printer by the paper feed unit 7. When the printing operation of one line is completed, the paper 4 is sent in the vertical direction against the direction of reciprocating motion and the continuous printing is carried out.

As described above, in a line printer apparatus, since a print shuttle unit with a print head mounted thereon makes reciprocating motions at high speed, such a structure as the whole apparatus is not vibrated due to the reciprocating motion is essential. Consequently, various structures to eliminate the vibration have been proposed in the prior arts.

According to Japanese Patent Application Laid-Open No. 61-169257 (1986), published is a line printer apparatus where a linear motor for reciprocating motions of a print shuttle unit with a print head thereon is constructed by a magnetic coil fixed to the lower side of the print shuttle unit and a movable type magnetic circuit section driving the magnetic coil. The magnetic circuit section of the linear motor is moved in the reverse direction against the print shuttle unit, and thereby the magnetic circuit section acts as a balancer of the print shuttle unit and the vibration is eliminated.

In the above-mentioned constitution, however, in order that the reciprocating motions in reverse phase of the print shuttle unit and the magnetic circuit section are maintained for a long period, both must be connected by a wire and the control of the reciprocating motions is not easy. On the other hand, a line printer apparatus is well known, where a balance shuttle unit made in nearly the same weight as a print shuttle unit makes reciprocating motions interlocking with the reciprocating motions of the print shuttle unit and in parallel and in reverse direction to this.

In the conventional apparatus of such a construction, the reaction force produced in a base frame or the like attendant along with the reciprocating motions of the print shuttle unit is offset and generation of the vibration is suppressed.

In the above-mentioned construction, however, when the print shuttle unit and the balance shuttle unit are moved in parallel in the reverse directions, rotational moment is generated due to the couple while both are moving. Thereby the rotational vibration is generated in the whole apparatus and the print quality may become bad due to the vibration of the printing paper.

In order to eliminate such disadvantages, an improved example to this is proposed in Japan Patent Application Laid-Open No. 6-040108 (1994). FIG. 2 is a perspective view of a shuttle mechanism in this improved example, and FIG. 3 is a sectional side elevation view, of the same. In FIG. 3, a white arrow indicates the direction of the gravity.

A print shuttle frame 12 with a print head 11 mounted thereon is slidably fitted to a shuttle shaft 2 arranged nearly at the center of the shuttle mechanism. The print shuttle frame 12 is supported by a roller 13 capable of traveling on a base frame 6 and the shuttle shaft 2. A plurality of coils 16 are arranged at a lower surface of a coil base plate 14, an iron plate, attached at the lower side of the print shuttle frame 12. A print shuttle unit 10 is composed of the print shuttle frame 12, the print head 11 and the coil base plate 14 mounted thereon and the coils 16, and can be moved along the shuttle shaft 2.

Opposed to the coils 16 arranged on the print shuttle unit 10, a plurality of permanent magnets 15 are arranged on a yoke 18, an iron plates fixed to the base frame 6 with a small gap between magnets 16 and the coils 16. A linear motor for driving the print shuttle unit 10 is constructed by the permanent magnets 15 and the coils 16. In the linear motor, current flows through the coils 16 within the magnetic field by the permanent magnets 15, and thereby thrust based on the Fleming's left-hand rule is generated in the coils 16 and the print shuttle unit 10 with the coils 16 mounted thereon is moved along the shuttle shaft 2. The current flowing through the coils 16 is controlled, and thereby the print shuttle unit 10 can be moved in reciprocating motion at high speed.

A balance shuttle frame 22 similar to the print shuttle frame 12 is slidably fitted to a shuttle shaft 3 arranged in parallel to the shuttle shaft 2. The balance shuttle frame 22 is supported by a roller 23 capable of traveling on the base frame 6 and the shuttle shaft 3. A weight 21 is mounted on the balance shuttle frame 22, and a plurality of coils similar to the coils 16 are arranged at a lower surface of a coil base plate 24 attached to the lower side of the balance shuttle frame 22. A pair of arms 29 projecting on both lateral sides of the balance frame 6 are coupled with the balance shuttle frame 22. The top end of the arm 29 gets beyond the installation position of the print shuttle unit 10 and reaches the opposite side, and a balance weight 30 is mounted on the top end. A roller 31 capable of traveling on the base frame 6 is attached to the balance weight 30. A balance shuttle unit 20 is composed of the balance shuttle frame 22, weight 21 and coil base plate 24 mounted on the balance shuttle frame 22, coils 26, arm 29 and balance weight 30 mounted on the top end of the arm 29, and can be moved along the shuttle shaft 3.

Opposed to the coils 26 arranged on the balance shuttle unit 20, a plurality of permanent magnets 25 similar to the permanent magnets 15 are arranged with a small gap between the magnets 25 and the coils 26 on a yoke 28 similar to the yoke 18.

A linear motor for driving the balance shuttle unit 20 is constructed by the permanent magnets 25 and coils 26. The linear motor for driving the balance shuttle unit 20, which is similar to that for driving the print shuttle unit 10, controls the current flowing through the coils 26, and thereby the balance shuttle unit 20 can be moved in reciprocating motion at high speed along the shuttle shaft 3.

The total weight of the balance shuttle unit 20 is nearly the same as that of the print shuttle unit 10. Also the weight distribution of the balance shuttle unit 20 is effected so that the traveling line of the center of gravity of the whole balance shuttle unit 20 while it is moving along the shuttle shaft 3 gets to nearly the same position as the traveling line of the center of gravity of the whole print shuttle weight 10 while it is moving along the shuttle shaft 2. In addition, numeral 5 in FIG. 3 designates a guide roller to feed the paper 4 into the shuttle mechanism (print mechanism section).

In the shuttle mechanism constituted as described above, when the print shuttle unit 10 is moved in reciprocating motions along the shuttle shaft 2, the balance shuttle unit 20, nearly the same weight as the print shuttle unit 10, is moved in reciprocating motions interlocking with the print shuttle unit 10 in the reverse direction at the same speed along the shuttle shaft 3. Consequently, the reaction force produced in the base frame 6 to the reciprocating motion of the print shuttle unit 10 is offset by the reciprocating motion of the balance shuttle unit 20. Also in this case, since the center of the gravity of the the balance shuttle unit 20 moves on the same line as the center of the gravity of the print shuttle unit 10 travels, the rotational moment is not generated due to the reciprocation motion of both. As a result, the vibration of the whole apparatus can be reduced.

In the above-mentioned construction, since, besides the balance shuttle frame 22, the arm 29 and the balance weight 30 makes the reciprocating motions interlocking with the print shuttle unit 10, a large mounting range is necessary for these members. Consequently, there is a problem that the required miniaturization of the apparatus is inhibited and the operability of the apparatus is deteriorated.

Also the shuttle mechanism shown in FIG. 2 and FIG. 3 realizes the suppression of the rotational moment produced due to the couple attendant on the reciprocating motion of the print shuttle unit 10 and the balance shuttle unit 20 by installing the balance weight 30 and making the traveling line of the center of the gravity of both shuttle units 10, 20 nearly the same. Consequently, mounting of the balance shuttle unit 20 for the balance weight 30 and the arm 29 mounting it must be carried out with good accuracy.

As the spaced difference between the print shuttle unit 10 and the balance shuttle unit 20 becomes longer, the balance weight 30 requires the heavier weight and the mounting design is subjected to the larger restriction. When the print shuttle unit 10 and the balance shuttle unit 20 are arranged closely and the positions of the center of the gravity of both shuttle units 10, 20 are nearly the same, the rotational moment as above described is not generated, and since the original balance operation of the balance shuttle unit 20 by the weight 21 only can be realized without the balance weight 30, a problem in mounting as above described is not produced.

Accordingly, it is essential to devise the mounting method which makes the positions of the center of gravity of both shuttle units 10, 20 as close as possible. However, in a method of mounting the balance shuttle unit 20 to the opposite side of the printing shuttle unit 10 against the paper traveling region interposed between both as seen in the above-mentioned shuttle mechanism, the reduction of the distance between both shuttle units 10, 20 has limitation. Because a space for the paper traveling path and an installation space of mechanism parts relating to printing such as a platen roll must be provided between both shuttle units 10, 20. Consequently, the mounting method which makes the positions of the center of gravity of both shuttle units 10, 20 as close as possible cannot be a reasonable mounting method.

SUMMARY OF THE INVENTION

The invention has been conducted in order to solve the above-discussed problems. The main object of the present invention is to provide a shuttle mechanism of a printer apparatus where not only the vibration of the apparatus can be suppressed but also the miniaturization of the shuttle mechanism and the improvement of the operability can be realized.

A shuttle mechanism of a printer apparatus according to the present invention is characterized in that a balance shuttle unit is arranged to the opposite side of the print head in a print shuttle unit, for example, to the under side. Thereby, since the position of the center of the gravity of the print shuttle unit and the balance shuttle unit get close, the rotational moment due to the couple is not generated and the vibration of the whole apparatus can be suppressed without installing a balance weight as in the prior arts. Also by adopting such a mounting style, common use of components such as magnets in both shuttle units may become possible.

A further object of the present invention is to provide a shuttle mechanism of a printer apparatus where the cost reduction by decreasing the number of parts and the miniaturization of the shuttle mechanism can be intended.

A shuttle mechanism of a printer apparatus according to the present invention is characterized in that the components of the print shuttle unit and those of the balance shuttle unit are positioned in relation of the linear symmetry, for example, magnets of the reciprocating mechanism utilizing the principle of the linear motor can be commonly used. Consequently, parts provided individually may be removed.

A further object of the present invention is to provide a shuttle mechanism of a printer apparatus where improvement of the shuttle mechanism in operability and assembling can be intended.

A shuttle mechanism of a printer apparatus according to the present invention is characterized in that a guide member for reciprocation motions of the print shuttle unit and the balance shuttle unit can be commonly used. Consequently, parts mounted individually in the prior arts can be mounted at once and the structure can be simplified significantly.

A further object of the present invention is to provide a shuttle mechanism of a printer apparatus where large thrust can be obtained.

A shuttle mechanism of a printer apparatus according to the present invention is characterized in that the printer shuttle unit and/or the balance shuttle unit have structure in combination of plural sets of coils and magnets. Accordingly, the thrust can be increased without enlarging the depth direction of the printer apparatus.

The above and further objects and features of the invention will more fully be apparent from the following detailed description with accompanying drawings.

DESCRIPTION OF THE PREFERRED EMBODIMENTS

Hereinafter, the present invention will be described according to the drawings showing the embodiments.

(The first embodiment)

Figure 1:
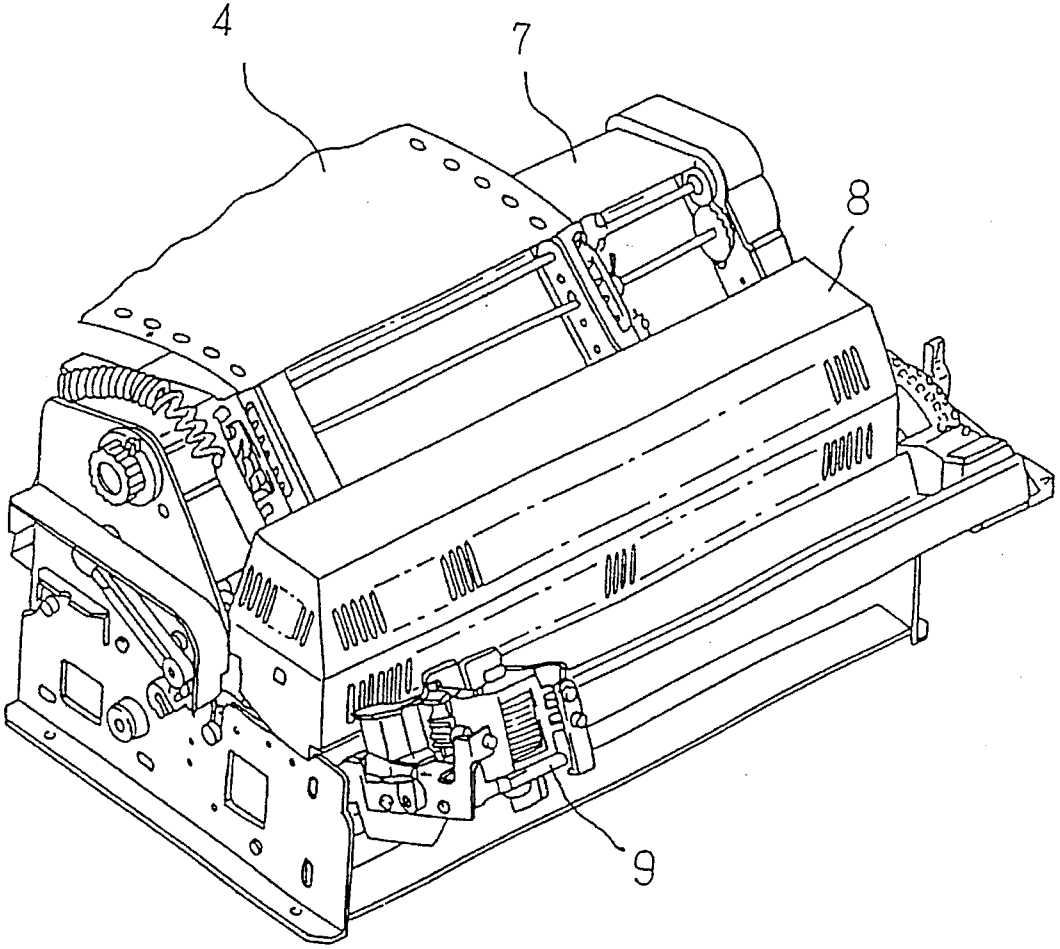
FIG. 1 PRIOR ART
FIG. 1 is a schematic appearance of a dot line printer apparatus.
Figure 2:
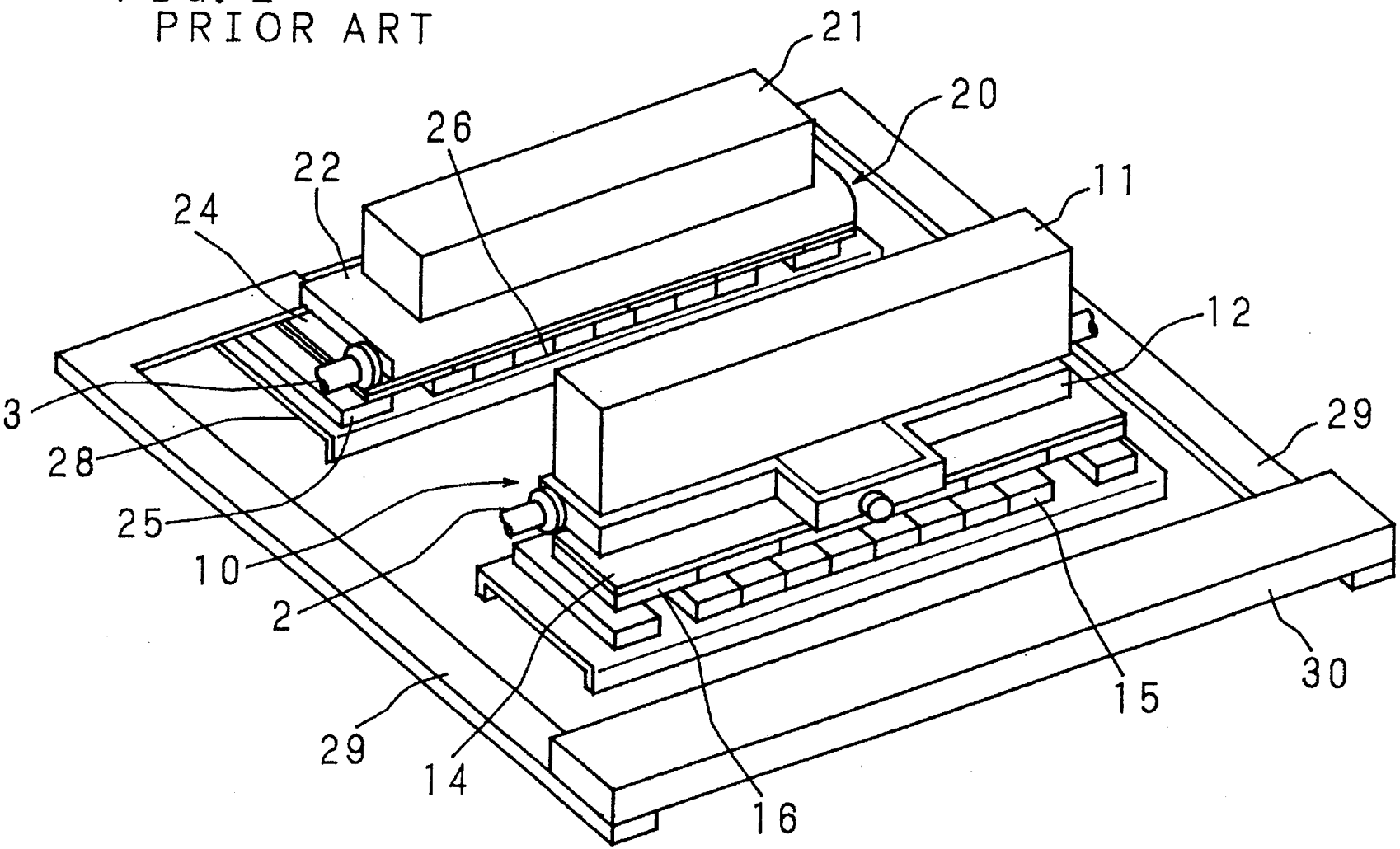
FIG. 2 PRIOR ART
FIG. 2 is a perspective view of a conventional shuttle mechanism.
Figure 3:
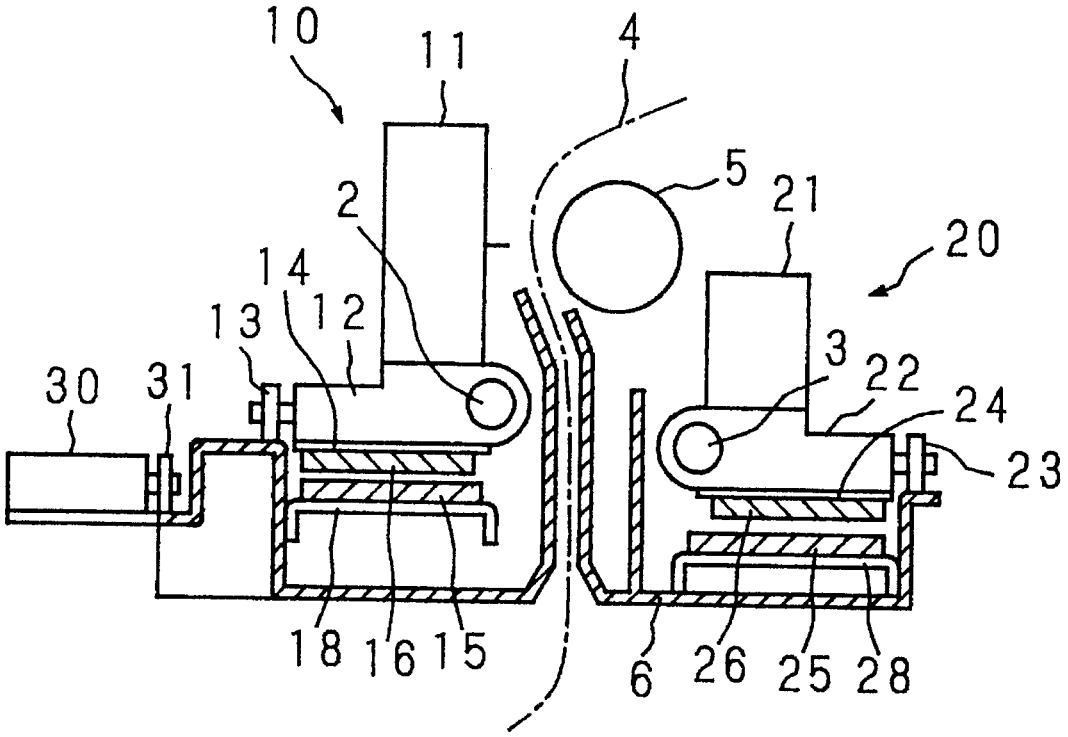
FIG. 3 PRIOR ART
FIG. 3 is a side elevation view, partly in cross section, of a conventional shuttle mechanism.
Figure 4:
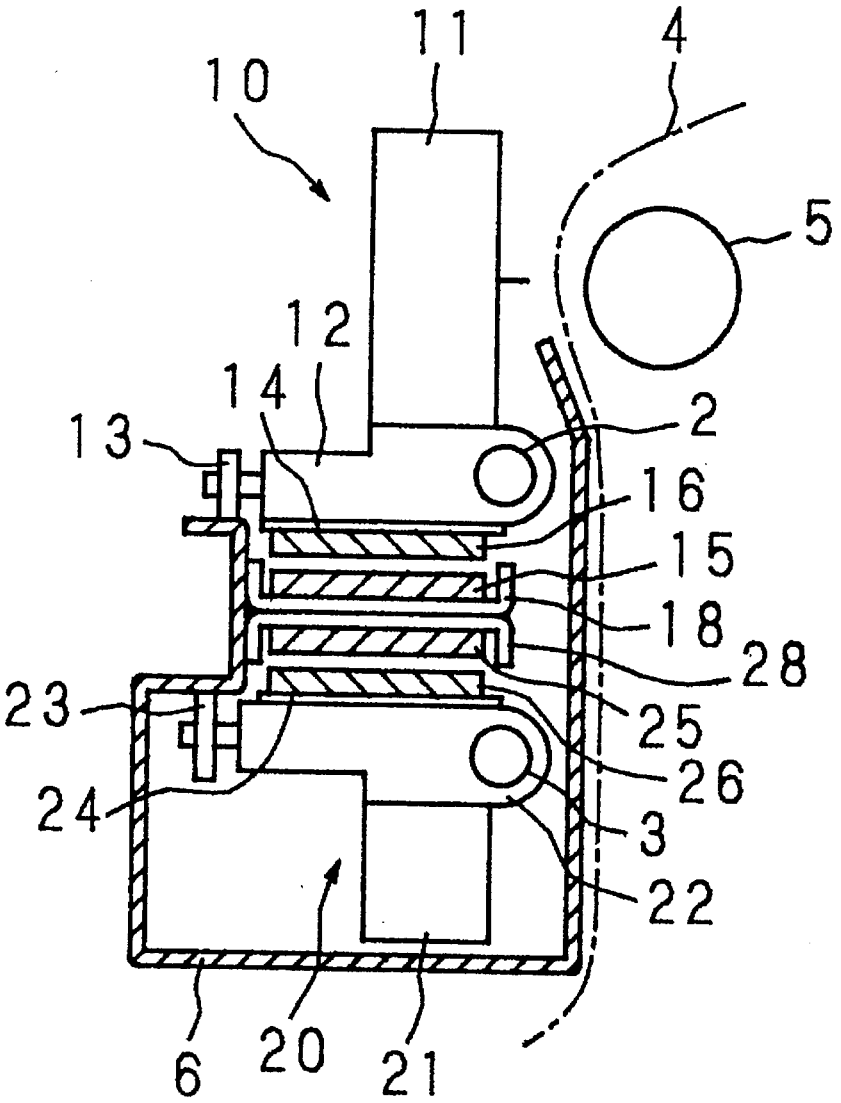
FIG. 4 is a sectional side elevation view, of a shuttle mechanism in the first embodiment of the present invention.

FIG. 4 is a sectional side elevation view, of a shuttle mechanism of a printer apparatus in accordance with the first embodiment of the present invention. In FIG. 4, the parts with the same reference numerals as those in FIG. 2 and FIG. 3 designate the same parts. The white arrow in FIG. 4 shows the direction of the gravitation.

Numeral 2 in the drawing designates a shuttle shaft disposed in the direction parallel to the width of the printing paper. A print shuttle frame 12 with a print head 11 mounted thereon is slidably inserted and supported on the shuttle shaft 2 and also supported on rollers 13 capable of traveling on a base frame 6 and the shuttle shaft 2. Plurality number of coils 16 are arranged in line on the under surface of a coil base plate 14 made of the iron plate attached to the bottom of the print shuttle frame 12. A print shuttle unit 10 is composed of the print shuttle frame 12, the print head 11 and the coil base plate 14 mounted with shuttle frame 12, the coils 16 and the like together as a unit, and movable along the shuttle 2. A plurality of permanent magnets 15 are arranged in line on a yoke 18 made of the iron plate secured to the base frame 6 in a state that the magnets 15 are opposite to the coils 16 with a slight gap. Those permanent magnets 15 and coils 16 form a linear motor for driving the printing shuttle unit 10.

Under the print shuttle unit 10, in a linear symmetrical position with the symmetrical axis, the under surface of the yoke 18, there is provided a balance shuttle unit 20 having a construction which will be described hereinafter. A balance shuttle frame 22 is slidably inserted and supported on the shuttle shaft 3 disposed parallel to the shuttle shaft 2 and also supported on rollers 23 capable of traveling on a base frame 6 and the shuttle shaft 3. On the under surface of the balance shuttle frame 22 is mounted a weight 21. A plurality of coils 26 are arranged in line on the upper surface of a coil base plate 24 made of the iron plate attached to the top of the balance shuttle frame 22. A balance shuttle unit 20 is composed of the balance shuttle frame 22, the weight 21 and the coil base plate 24 attached to the frame 22, the coils 26 and the like together as a unit, and movable along the shuttle shaft 3. A plurality of permanent magnets 25 are arranged in line on the under surface of a yoke 28 made of the iron plate secured to the base frame 6 in a state that the magnets 25 are opposite to the coils 26 with a slight gap. These permanent magnets 25 and coils 26 form a linear motor for driving the balance shuttle unit 20.

The under surface of the yoke 18 of the print shuttle unit 10 side is in contact With the upper surface of the yoke 28 of the balance shuttle unit 20 side, and both the shuttle units 10, 20 are provided on the opposite sides of the contact surface. Moreover, the total weight of the balance shuttle unit 20 is substantially equal to that of the print shuttle unit 10. Incidentally, numeral 5 in FIG. 4 designates a guide roller for feeding the print paper 4 into the shuttle mechanism (print mechanism section).

In the shuttle mechanism which is constituted as described above, when the coils 16 and coils 26 are charged with electricity, the print shuttle unit 10 reciprocates along the shuttle shaft 2 while the balance shuttle unit 20, nearly the same weight as the print shuttle unit 10, reciprocates along the shuttle shaft 3 at the same speed, in the reverse direction and linking to the print shuttle unit 10. Accordingly, the reaction force produced on the base frame 6 against the reciprocal motions of the print shuttle unit 10 is offset by the reciprocal motion of the balance shuttle unit 20. Further, in this case the positions of the center of the gravity in both the shuttle units 10, 20 are substantially identical so that the rotation moment due to the reciprocal motions of both the units is scarcely generated. As a result, the vibration of the whole apparatus can be suppressed. Furthermore, according to the configuration of the installation as described above, the installation area of each component of the shuttle mechanism is limited in a certain comparative narrow area. Therefore, the shuttle mechanism can be constructed in a compact installation and thereby the maintainability and assembling ability of the apparatus can be improved while it becomes possible to assemble the whole shuttle mechanism as a unit.

(The second embodiment)

Figure 5:
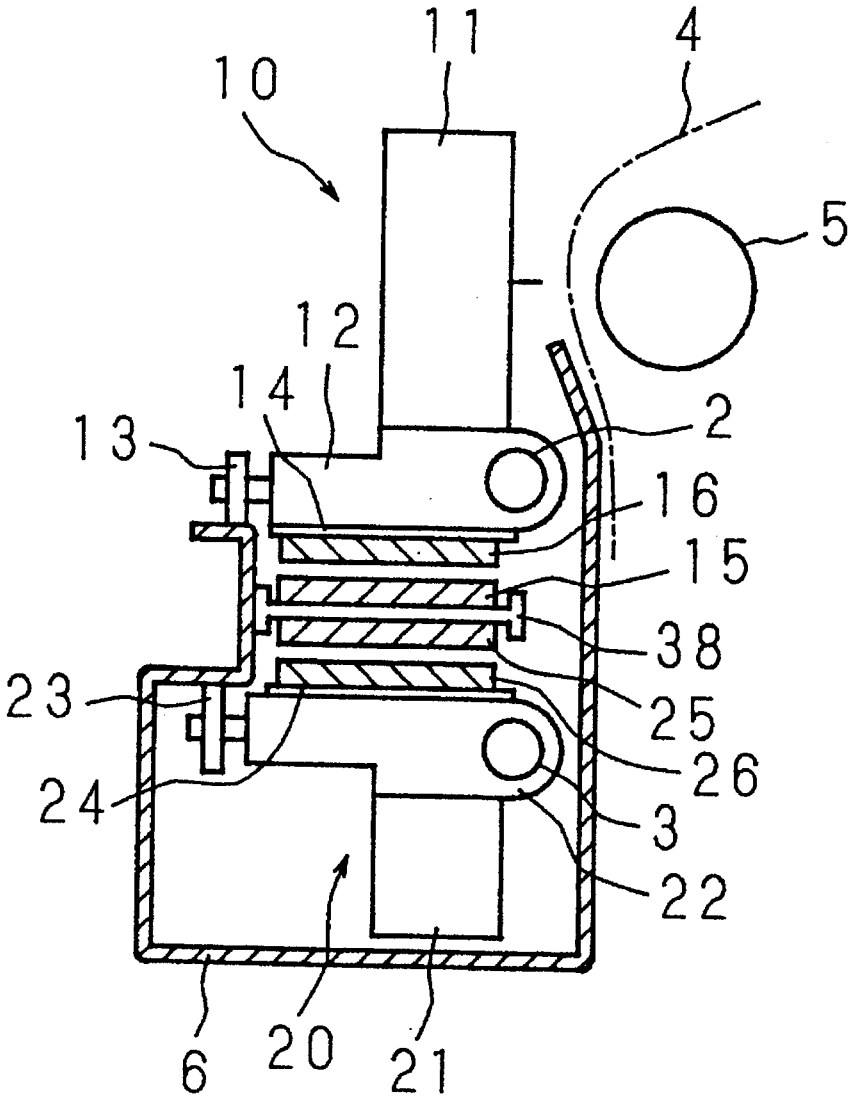
FIG. 5 is a sectional side elevation view, of a shuttle mechanism in the second embodiment of the invention.

FIG. 5 is a sectional side elevation view, of a shuttle mechanism of a printer apparatus in accordance with the second embodiment of the invention. The same parts in FIG. 5 as those in FIG. 4 are given the same reference numerals and the description is omitted.

The construction in the second embodiment is adapted so that the yoke 18 for the print shuttle unit 10 side and the yoke 28 for the balance unit 20 side in the first embodiment are unified in a common yoke. Namely, there is provided one yoke 38 fixed to the base frame 6 as a common yoke for both the permanent magnets 15, 25.

As constructed above, it may become feasible to assemble the whole shuttle mechanism as a unit, to save the cost by decreasing the number of the components, and to size down the shuttle mechanism.

(The third embodiment)

Figure 6:
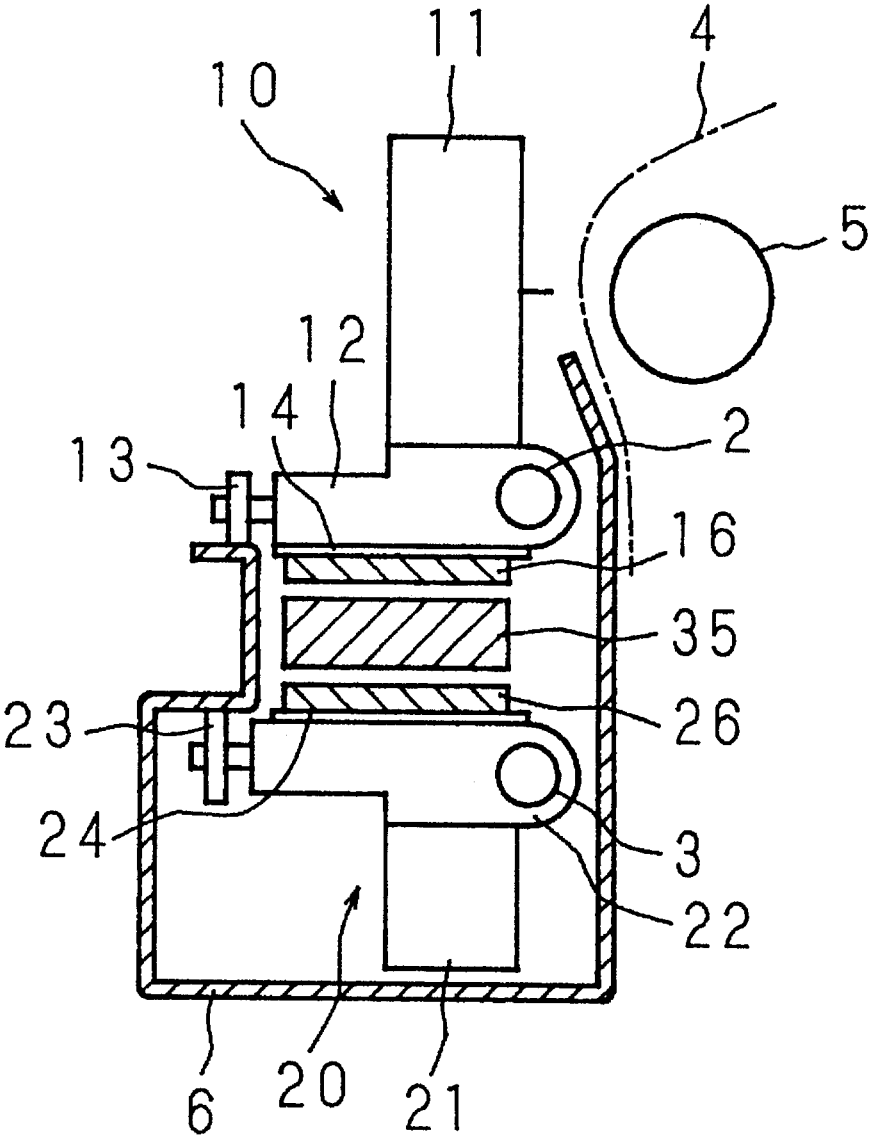
FIG. 6 is a sectional side elevation view, of a shuttle mechanism in the third embodiment of the invention.

FIG. 6 is a sectional side elevation view, of a shuttle mechanism of a printer apparatus in the third embodiment of the invention. The same parts in FIG. 6 as those in FIG. 4 are given the same reference numerals and the description is omitted.

The construction in the third embodiment is adapted so that the permanent magnet 15 of the print shuttle unit 10 side and the permanent magnet 25 of the balance shuttle unit 20 side in the second embodiment are unified as a common permanent magnet. Namely, there is removed the yoke 38 and provided one set of permanent magnets 35 fixed to the base frame 6 as common permanent magnets for both the linear motor mechanisms.

As constructed above, it may become feasible to assemble the whole shuttle mechanism as a unit, to further save the cost by decreasing the numbers of the components, and to further size down the shuttle mechanism.

(The fourth embodiment)

Figure 7:
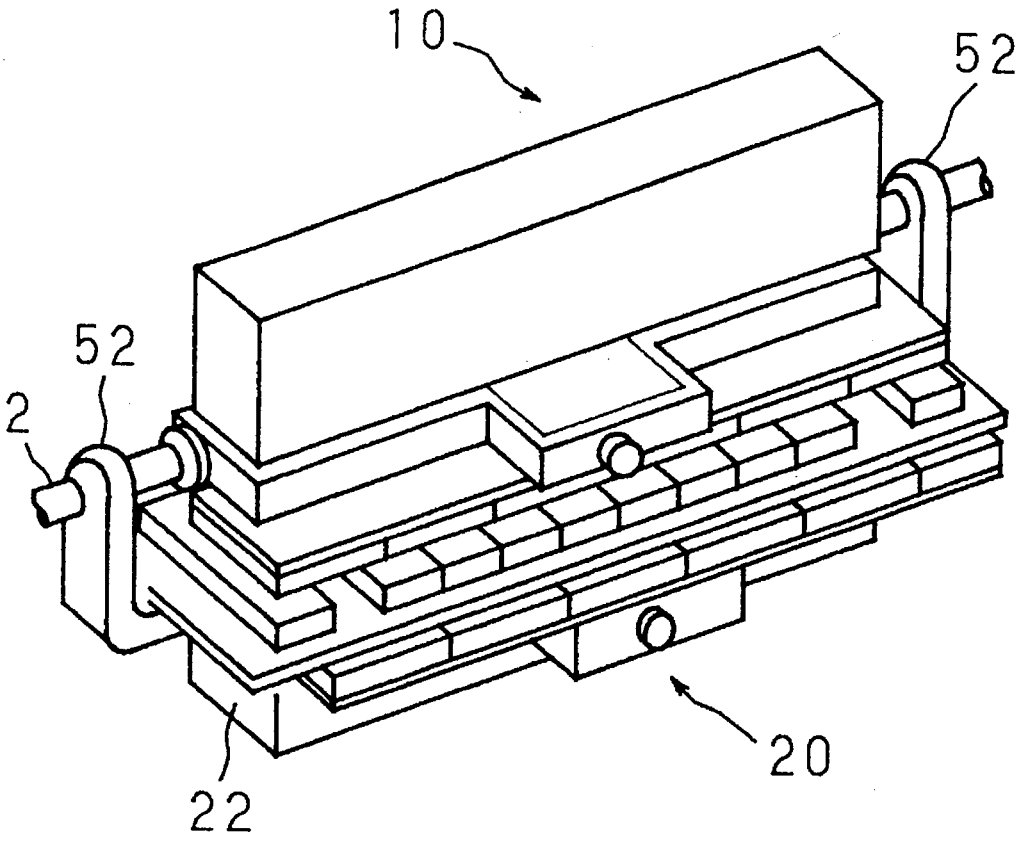
FIG. 7 is a perspective view of a shuttle mechanism in the fourth embodiment of the invention.

FIG. 7 is a perspective view of a shuttle mechanism of a printer apparatus in the fourth embodiment of the invention. The same parts in FIG. 7 as those in FIG. 4 are given the same reference numerals and the description is omitted.

The construction in the fourth embodiment is adapted so that the shuttle shaft for the print shuttle unit 10 and the shuttle shaft for the balance shuttle unit 20 in the first, second or third embodiment are unified as a common shuttle shaft. As shown in FIG. 7, with the balance shuttle frame 22 of the balance shuttle unit 20 is provided an arm 52, which is inserted on the shuttle shaft 2 of the print shuttle unit 10. As a result, the shuttle shaft 3 as a guide for the reciprocal motions of the balance shuttle unit 20 is removed, and the function thereof is performed by the shuttle shaft 2. Alternatively, it is possible to modify the balance shuttle frame 22 itself to an arm form instead of providing the arm 52.

As constructed above, it may become feasible to assemble the whole shuttle mechanism as a unit, to save the cost by decreasing the number of the components, to improve the operability and assembling the productivity of the shuttle mechanism, and to size down the shuttle mechanism.

(The fifth embodiment)

Figure 8:
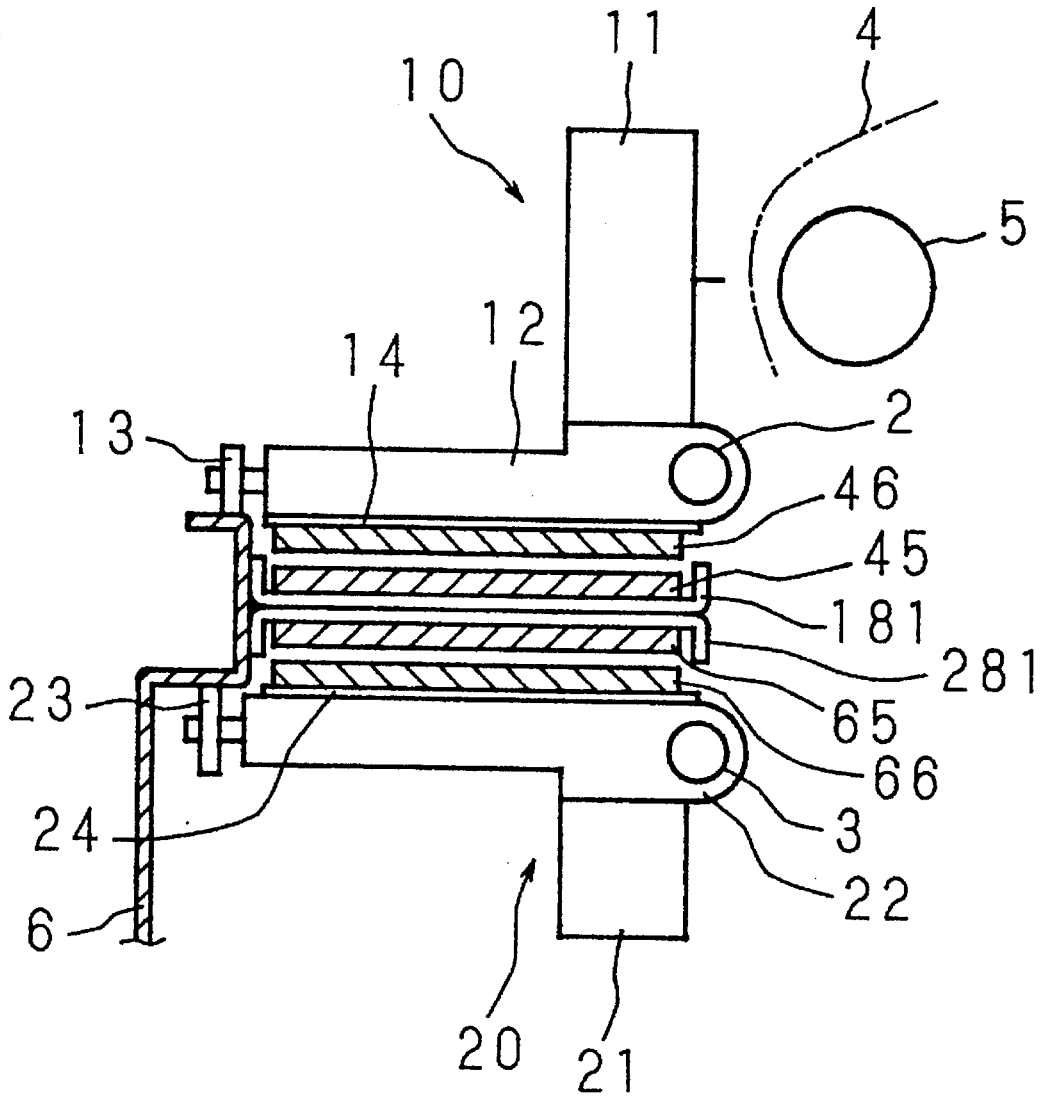
FIG. 8 is a sectional side elevation view, of a shuttle mechanism in the fifth embodiment of the invention.

FIG. 8 is a sectional side elevation view, of a shuttle mechanism in the fifth embodiment of the invention. The same parts in FIG. 8 as those in FIG. 4 are given the same reference numerals and the description is omitted.

For the method of increasing the thrust power in the shuttle mechanism, the ordinary way is to increase the sectional areas of the permanent magnet and coil in the linear motor mechanism. Since the amount of the reciprocal motions of the print head is fixed, it is impossible to enlarge the area in the direction parallel to the width of the print paper (or the direction parallel to the width of the printer). Then, in the embodiment shown in FIG. 8, the permanent magnets 45 and coils 46 of the print shuttle unit 10 are enlarged in the vertical direction to the print paper face (or in the depth direction of the printer). Moreover, yokes 181, 281, which are in the depth enlarged forms of yokes 18, 28 shown in FIG. 4, are provided instead of them. Also the balance shuttle unit 20 is provided with depth enlarged permanent magnets 65 and coils 66. However,in this case, there is a problem that the shuttle mechanism is too large so that the operability is deteriorated as well as the problem of the installation of the apparatus due to the enlargement of the printer in the depth direction.

(The sixth embodiment)

Figure 9:
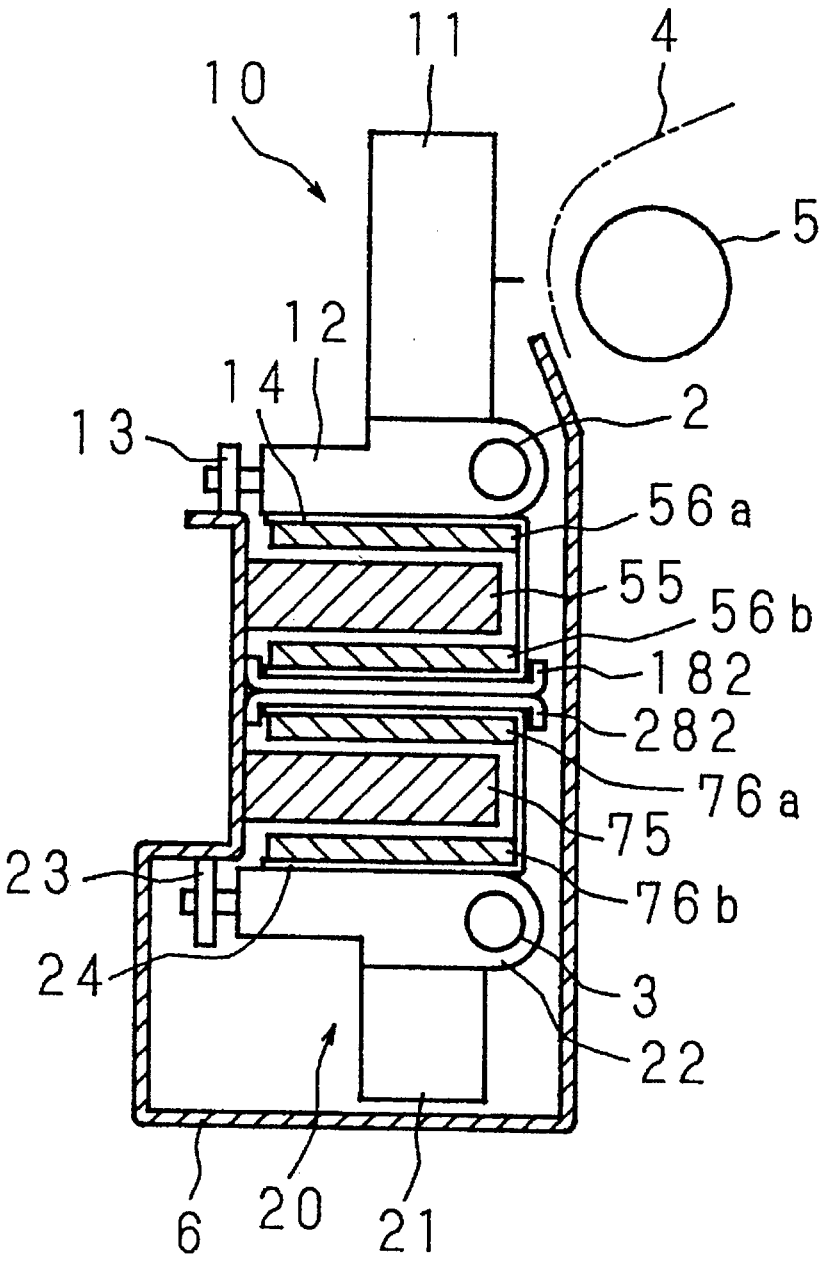
FIG. 9 is a sectional side elevation view, of a shuttle mechanism in the sixth embodiment of the invention.

FIG. 9 is a sectional side elevation view, of a shuttle mechanism of a printer apparatus in the sixth embodiment of the invention. The same parts in FIG. 9 as those in FIG. 4 are given the same reference numerals and the description is omitted.

In this embodiment, the print shuttle unit 10 is constructed so that the coil is divided into a plurality of coils (two coils of 56*a*, 56*b* in the illustrated example), and a permanent magnet (one magnet of 55 in the illustrated example) is disposed between the adjacent coils. The balance shuttle unit 20 is also constructed in the same manner. That is, the coil is divided into a plurality of coils (two coils of 76*a*, 76*b* in the illustrated example), and a Permanent magnet (one magnet of 75 in the illustrated example) is disposed between the adjacent coils. Moreover, between the print shuttle unit 10 and the balance shuttle unit 20, there is provided the same yokes 182, 282 as those shown in FIG. 4. According to such construction, a large thrust is obtained in a small size shuttle mechanism.

(The seventh embodiment)

Figure 10:
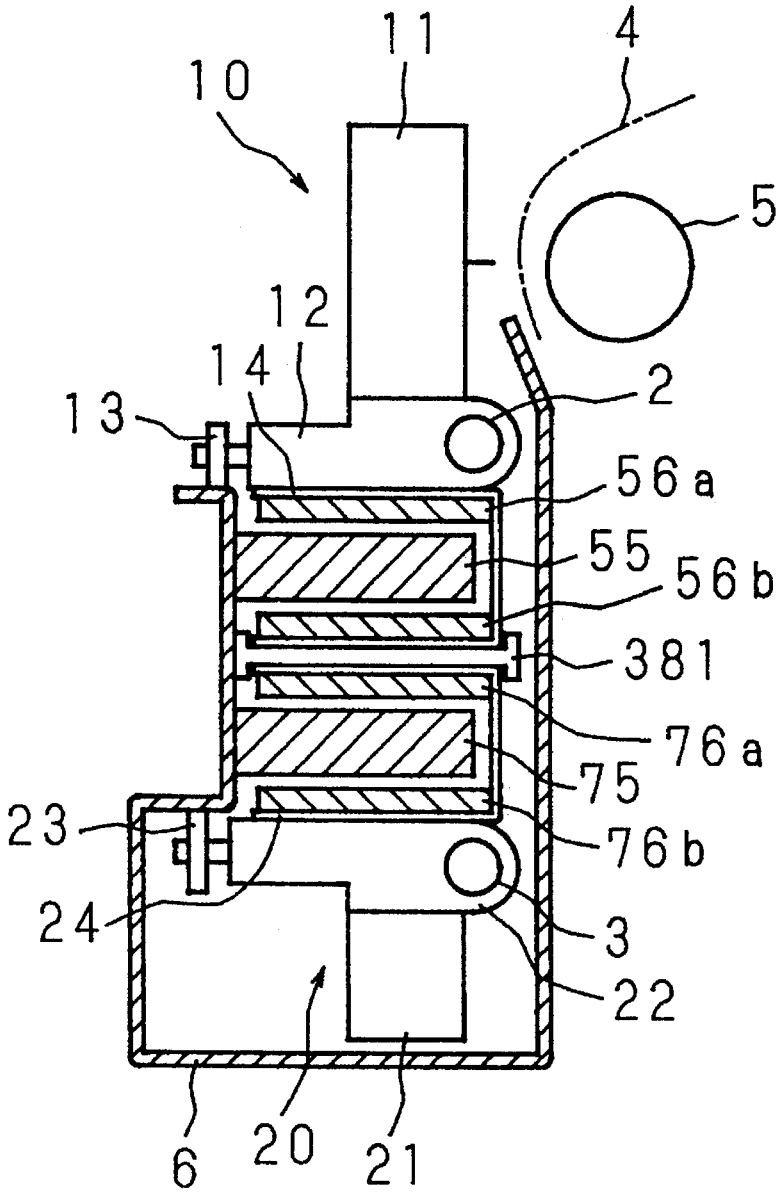
FIG. 10 is a sectional side elevation view, of a shuttle mechanism in the seventh embodiment of the invention.

FIG. 10 is a sectional side elevation view, of a shuttle mechanism of a printer apparatus in the seventh embodiment of the invention. The same parts in FIG. 10 as those in FIG. 9 are given the same reference numerals and the description is omitted.

In this embodiment, between the print shuttle unit 10 and the balance shuttle unit 20 constructed as shown in FIG. 9, there is provided one yoke 381 fixed to the base frame 6 as a common yoke which is similar to the yoke shown in FIG. 5. According to such construction, the embodiment is effective in obtaining a large thrust as described in the sixth embodiment and decreasing the number of the components and miniaturizing the shuttle mechanism as described in the second embodiment.

(The eighth embodiment)

Figure 11:
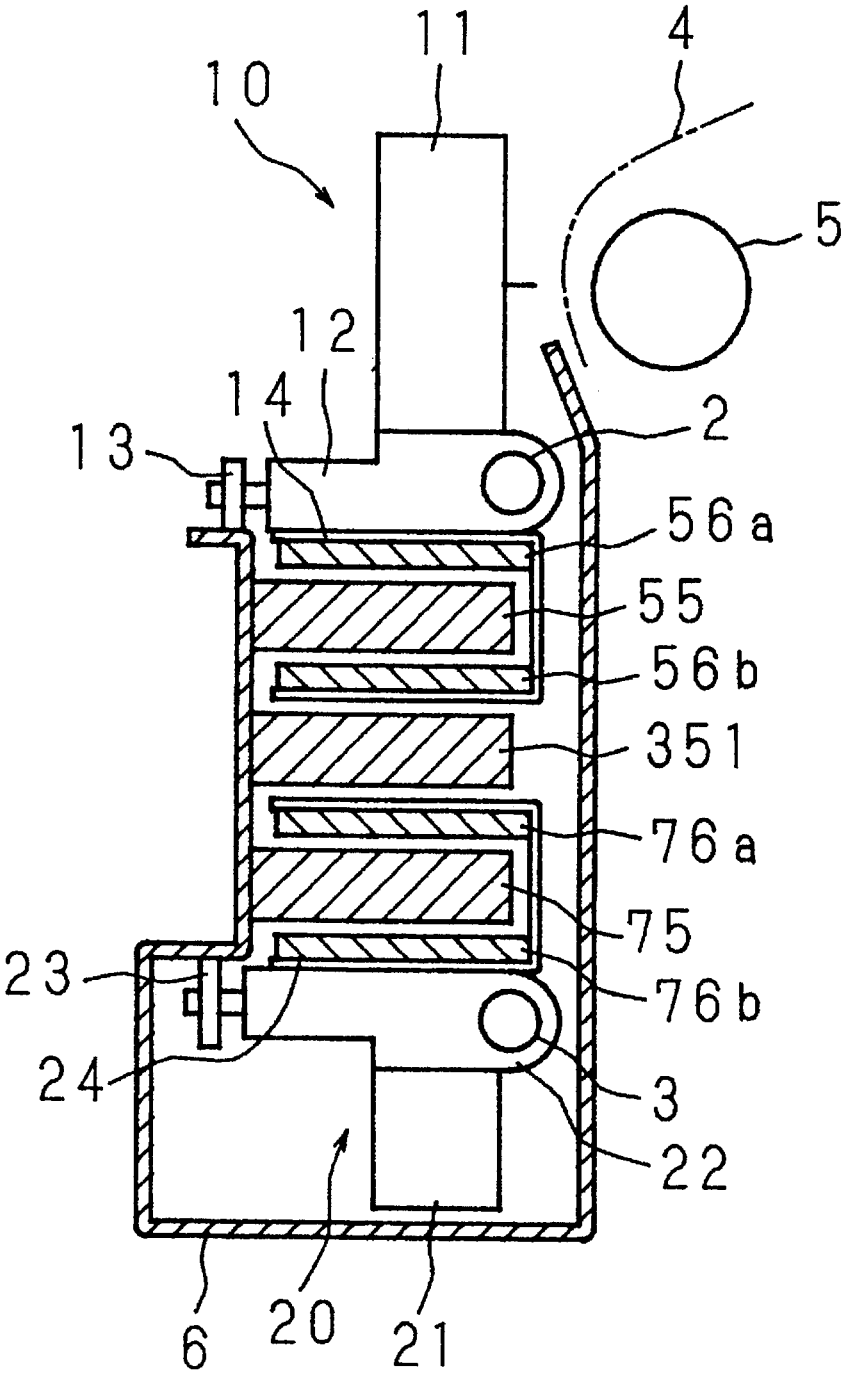
FIG. 11 is a sectional side elevation view, of a shuttle mechanism in the eighth embodiment of the invention.

FIG. 11 is a sectional side elevation view, of a shuttle mechanism of a printer apparatus in tile eighth embodiment of the invention. The same parts in FIG. 11 as those in FIG. 9 are given the same reference numerals and the description is omitted.

In this embodiment, between the print shuttle unit 10 and the balance shuttle unit 20 constructed as shown in FIG. 9, there is provided a permanent magnet 351 fixed to the base frame 6 as a common permanent magnet which is similar to the permanent magnet 35 shown in FIG. 6. According to such construction, the embodiment is effective in obtaining a large thrust as described in the sixth embodiment and decreasing the numbers of the components and miniaturizing the shuttle mechanism as described in the third embodiment. Alternatively, the construction having a plurality of sets of the coils and permanent magnets as described above may be applied either to the print shuttle unit 10 or to the balance shuttle unit 20. Further alternatively, the installation direction of the coils and permanent magnets are not limited to the horizontal state as shown in the drawing, but the coils and permanent magnets may be installed in the vertical direction so as to obtain the similar effect.

As described above, the shuttle mechanism of the printer apparatus in accordance with the present invention is composed separately of the print shuttle unit and the balance shuttle unit and constructed so that the balance shuttle unit is disposed under the print shuttle unit. Therefore, the shuttle mechanism of the printer apparatus can suppress the vibration of the whole apparatus due to the reciprocal motions of the print head. Furthermore, since the rotation moment is not generated in the apparatus even when the balance weight in the prior art is not provided, the space for the installation of the apparatus can be made smaller, so that it is feasible to miniaturize the mechanism, to decrease the cost, and further to improve the operability and reliability of the apparatus.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A shuttle mechanism of a printer apparatus, comprising a print shuttle unit to mount a print head on one side thereof;

a common guide member provided along the width direction of a print paper;

a reciprocating mechanism to make said print shuttle unit reciprocate along said common guide member;

a balance shuttle unit as a balancer of said print shuttle unit; and another reciprocating mechanism to make said balance shuttle unit reciprocate along said common guide member in the reverse direction relative to said print shuttle unit, wherein each reciprocating mechanism is driven by a linear motor, and wherein said balance shuttle unit is arranged on another side of said print shuttle unit such that said print shuttle unit and said balance shuttle unit reciprocate respectively.

2. A shuttle unit of a printer apparatus as claimed in claim 1, wherein a common magnet is employed by each reciprocating mechanism.

3. A shuttle unit of a printer apparatus as claimed in claim 1, wherein said print shuttle unit and/or said balance shuttle unit are reciprocated by the power obtained from a plurality of sets of coils and magnets.

4. A shuttle unit of a printer apparatus as claimed in claim 2, wherein said print shuttle unit and/or said balance shuttle unit are reciprocated by the power obtained from a plurality of sets of coils and magnets.

* * * * *